US009520661B1

(12) United States Patent
Horning et al.

(10) Patent No.: US 9,520,661 B1
(45) Date of Patent: Dec. 13, 2016

(54) ELECTRICAL CONNECTOR ASSEMBLY

(71) Applicant: TYCO ELECTRONICS CORPORATION, Berwyn, PA (US)

(72) Inventors: Michael James Horning, Lancaster, PA (US); Wayne Samuel Davis, Harrisburg, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/835,211

(22) Filed: Aug. 25, 2015

(51) Int. Cl.
*H01R 12/70* (2011.01)
*H01R 13/6585* (2011.01)

(52) U.S. Cl.
CPC ..... *H01R 12/7076* (2013.01); *H01R 13/6585* (2013.01)

(58) Field of Classification Search
CPC ..... H01R 13/6471
See application file for complete search history.

(56) References Cited

U.S. PATENT DOCUMENTS 6,641,411 B1 * 11/2003 Stoddard ..... H01L 23/49838 257/E23.07
7,137,832 B2 * 11/2006 Mongold ..... H01R 13/6474 439/108
7,207,807 B2 * 4/2007 Fogg ..... H01R 13/6461 439/65
7,621,781 B2 * 11/2009 Rothermel ..... H01R 13/04 439/607.05
7,637,777 B1 * 12/2009 Trout ..... H01R 13/502 439/607.1
7,651,373 B2 * 1/2010 Knaub ..... H01R 23/688 439/108
7,666,009 B2 * 2/2010 Minich ..... H01R 13/443 439/101
7,708,569 B2 * 5/2010 Sercu ..... H01R 12/724 439/108
7,862,344 B2 * 1/2011 Morgan ..... H01R 13/6467 439/108
7,896,698 B2 * 3/2011 Trout ..... H01R 13/113 439/607.1
7,905,751 B1 * 3/2011 Davis ..... H01R 13/6587 439/607.05
7,914,305 B2 * 3/2011 Amleshi ..... H01R 13/6471 439/101
8,070,514 B2 * 12/2011 Trout ..... H01R 13/113 439/607.1

(Continued)

*Primary Examiner* — Ross Gushi

(57) ABSTRACT

An electrical connector assembly includes a housing extending between a mating end and a mounting end. The housing defines plural contact cavities extending through the housing. Signal contacts are disposed in corresponding contact cavities of the housing. The signal contacts are arranged in rows along row axes extending in a longitudinal direction and in columns along column axes extending in a lateral direction. The signal contacts are arranged in pairs. A first set of pairs of signal contacts defining column pairs being arranged in-column along the corresponding column axis and a second set of pairs of signal contacts define cross pairs being arranged across the corresponding column axis. Adjacent pairs of signal contacts along the column axes alternate between column pairs and cross pairs. Adjacent pairs of signal contacts along row axes alternate between column pairs and cross pairs.

19 Claims, 4 Drawing Sheets

(56) References Cited

U.S. PATENT DOCUMENTS

| | | | | |
|---|---|---|---|---|
| 8,371,876 | B2 * | 2/2013 | Davis | H01R 12/724 439/108 |
| 8,444,436 | B1 * | 5/2013 | Cohen | H05K 1/115 439/607.08 |
| 8,475,183 | B2 * | 7/2013 | Chien | H01R 12/585 439/101 |
| 8,550,852 | B2 * | 10/2013 | Goossens | H01R 13/6461 439/626 |
| 8,920,194 | B2 * | 12/2014 | Minich | H01R 13/6471 439/607.05 |
| 2004/0097112 | A1 * | 5/2004 | Minich | H01R 29/00 439/101 |
| 2008/0214059 | A1 * | 9/2008 | Rothermel | H01R 13/6477 439/701 |

* cited by examiner

ELECTRICAL CONNECTOR ASSEMBLY

BACKGROUND OF THE INVENTION

The subject matter herein relates generally to electrical connector assemblies.

Some electrical connector systems utilize mating electrical connector assemblies to interconnect two circuit boards, such as a motherboard and daughter card. The conductors of one electrical connector assembly are terminated to one circuit board and extend through the housing towards a mating end to engage mating conductors of the mating connector assembly terminated to the other circuit board.

Some known electrical connector assemblies have electrical problems, particularly when transmitting at high data rates. For example, the electrical connector assemblies typically utilize differential pair signal conductors to transfer high speed signals. Electrical shielding is needed between pairs of signal conductors, and thus the electrical connector assemblies are populated with ground conductors interspersed among the pairs of signal conductors. The ground conductors improve the signal integrity. However, the ground conductors occupy valuable space within the electrical connector assemblies, causing problems with conductor density and connector assembly size or footprint. Other known electrical connector assemblies utilize shielded modules that provide electrical shielding, such as from a conductive shell or shield plates, between each row and column of signal conductors. While such designs are electrically effective at shielding the signal transmission lines, the shielding is costly and occupies valuable space within the connector, reducing the density of the electrical connector assemblies.

A need remains for a high density, high speed electrical connector assembly that is reliable and cost effective.

BRIEF DESCRIPTION OF THE INVENTION

In an embodiment, an electrical connector assembly is provided including a housing extending between a mating end and a mounting end. The housing defines plural contact cavities that extend through the housing between the mating end and the mounting end. Signal contacts are disposed in corresponding contact cavities of the housing. The signal contacts are arranged in rows along row axes extending in a longitudinal direction and are arranged in columns along column axes extending in a lateral direction. The signal contacts are arranged in pairs. A first set of pairs of signal contacts defining column pairs being arranged in-column along the corresponding column axis and a second set of pairs of signal contacts define cross pairs being arranged across the corresponding column axis. Adjacent pairs of signal contacts along the column axes alternate between column pairs and cross pairs. Adjacent pairs of signal contacts along row axes alternate between column pairs and cross pairs.

In another embodiment, an electrical connector assembly is provided including a housing extending between a mating end and a mounting end. The housing defines plural contact cavities that extend through the housing between the mating end and the mounting end. Signal contacts are disposed in corresponding contact cavities of the housing. The signal contacts are arranged in rows along row axes extending in a longitudinal direction and are arranged in columns along column axes extending in a lateral direction. The signal contacts are arranged in pairs. Each pair of signal contacts is populated on at least one side along the corresponding row axis with another pair of signal contacts and each pair of signal contacts is populated on at least one side along the corresponding column axis with another pair of signal contacts. Each pair of signal contacts define either a column pair or a cross pair. The signal contacts of the column pair are arranged in-column along the corresponding column axis. The signal contacts of the cross pair are arranged across the corresponding column axis. Each column pair is surrounded on all populated sides by cross pairs and each cross pair is surrounded on all populated sides by column pairs.

In a further embodiment, an electrical connector assembly is provided including a header assembly and a receptacle assembly. The header assembly includes a header housing extending between a mating end and a mounting end. The mating end has a chamber. The header assembly includes header signal contacts held by the header housing and arranged in an array in the chamber having a first layout. The header signal contacts are arranged in rows along row axes and are arranged in columns along column axes. The header signal contacts are arranged in pairs. A first set of pairs of header signal contacts define column pairs arranged in-column along the corresponding column axis. A second set of pairs of header signal contacts define cross pairs being arranged across the corresponding column axis. Adjacent pairs of signal contacts along the column axes alternate between column pairs and cross pairs. Adjacent pairs of signal contacts along the row axes alternate between column pairs and cross pairs. The receptacle assembly includes a receptacle housing extending between a mating end and a mounting end. The mating end is received in the chamber of the header housing. The receptacle assembly includes receptacle signal contacts held by the receptacle housing. The receptacle signal contacts are arranged in a second layout complementary to the first layout along row axes and column axes such that the receptacle signal contacts are mated with corresponding header signal contacts.

DETAILED DESCRIPTION OF THE INVENTION

Figure 1:
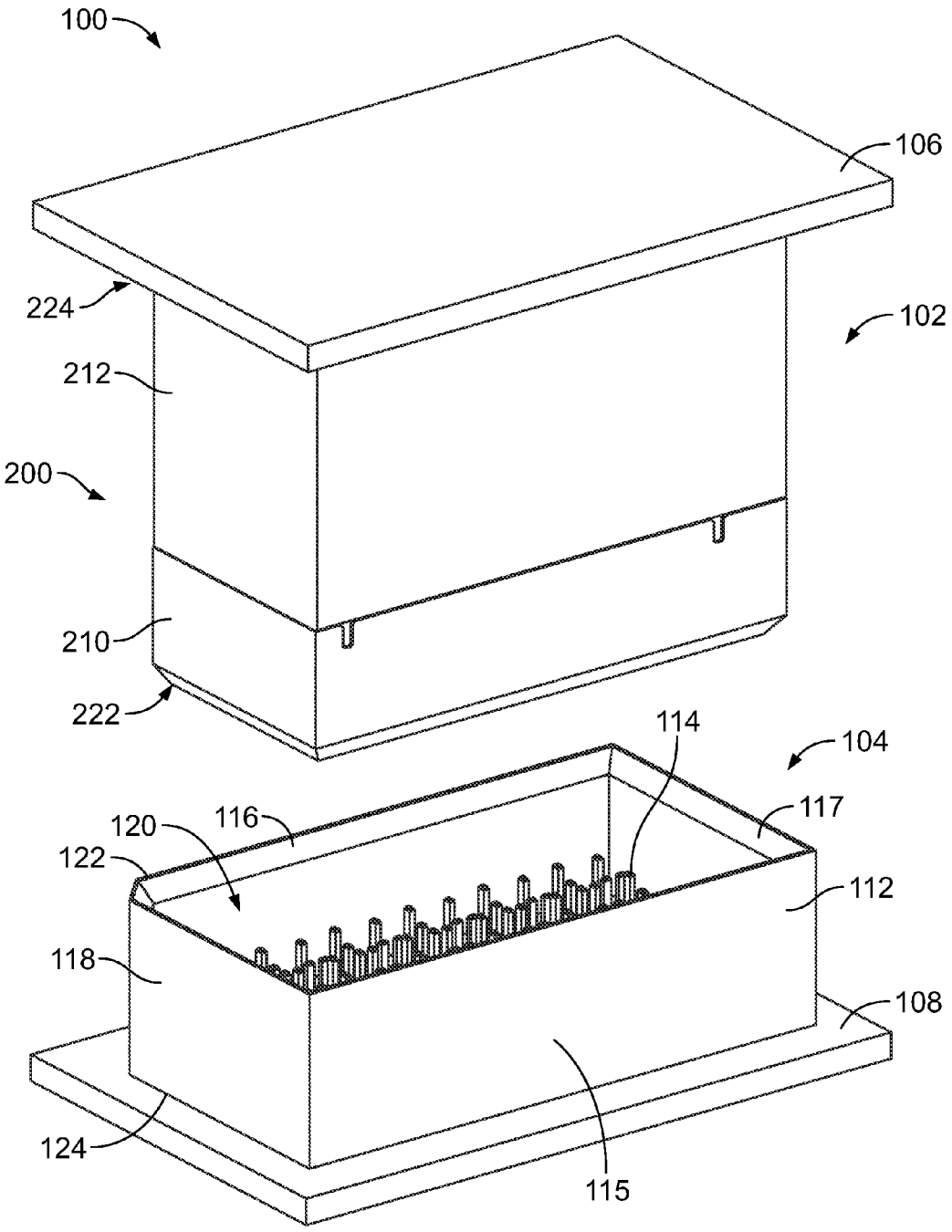
FIG. 1 is a top perspective view of an electrical connector system 100 formed in accordance with an embodiment.

FIG. 1 is a top perspective view of an electrical connector system 100 formed in accordance with an embodiment. The electrical connector system 100 includes a first electrical connector assembly 102 and a second electrical connector assembly 104 that are configured to be directly mated together. The electrical connector system 100 may be disposed on or in an electrical component, such as a server, a computer, a router, or the like. In FIG. 1, the first electrical connector assembly 102 and the second electrical connector assembly 104 are shown un-mated, but poised for mating to one another.

The first electrical connector assembly 102 and the second electrical connector assembly 104 are configured to be electrically connected to respective first and second circuit boards 106, 108. The first and second electrical connector assemblies 102, 104 are utilized to provide a signal transmission path to electrically connect the circuit boards 106, 108 to one another at a separable mating interface. In FIG. 1, the first electrical connector assembly 102 is mounted to the first circuit board 106, and the second electrical connector assembly 104 is mounted to the second circuit board 108. In an embodiment, the first and second circuit boards 106, 108 are oriented parallel to one another when the first and second electrical connector assemblies 102, 104 are mated. As such, the electrical connector system defines a mezzanine connector system with the connector assemblies 102, 104 arranged between the parallel circuit boards 106, 108. Optionally, the connector assemblies 102, 104 may have variable heights to provide a desired distance (or fit) between the parallel circuit boards 106, 108. Alternative relative orientations of the circuit boards 106, 108, such as a perpendicular orientation, are possible in other embodiments. In an alternative embodiment, the first electrical connector assembly 102 and/or the second electrical connector assembly 104 may be terminated to one or more cables rather than being board mounted.

In an exemplary embodiment, the first electrical connector assembly 102 is a receptacle assembly, and the second electrical connector assembly 102 is a header assembly. The electrical connector assemblies 102, 104 may be referred to herein as receptacle assembly 102 and header assembly 104, respectively. In an embodiment, the receptacle assembly 102 is modular in design, having at least two modules or units stacked together to define the height of the receptacle assembly 102, which affects the distance between the circuit boards 106, 108 when the assemblies 102, 104 are mated. Although not shown in FIG. 1, the header assembly 104 in an alternative embodiment may be modular with stackable modules or units to adjust the height of the header assembly 104 in addition to, or as an alternative to, the receptacle assembly 102 being stackable. Therefore, components of the electrical connectors shown and described in the embodiments herein are not limited to a specific style of connector and may correspond to a receptacle-style connector, a plug-style connector, a header-style connector, or other styles of connectors.

In the illustrated embodiment, the header assembly 104 includes a header housing 112 and a plurality of header contacts 114. The header housing 112 extends between a mating end 122 and a mounting end 124. The header housing 112 includes multiple outer walls that define a chamber 120 therebetween. For example, the header housing 112 may include opposite sides 115, 116 and opposite ends 117, 118; however, the header housing 112 may have other walls defining other shaped housings. Optionally, the sides 115, 116 are longer than the ends 117, 118 and thus the sides 115, 116 extend in a longitudinal direction and the ends 117, 118 extend in a lateral direction.

The chamber 120 is open at the mating end 122 of the header housing 112 and is configured to receive a portion of the receptacle assembly 102 therein. All or at least some of the outer walls may be beveled at the mating end 122 to provide a lead-in section to guide the receptacle assembly 102 into the chamber 120 during mating. In the illustrated embodiment, the header housing 112 has a fixed height between the mating end 122 and the mounting end 124. The header housing 112 may be formed of at least one dielectric material, such as a plastic or one or more other polymers. The mounting end 124 of the header housing 112 faces, and may also engage, a surface of the second circuit board 108.

The receptacle assembly 102 includes a housing stack 200 that extends between a mating end 222 and a mounting end 224. The housing stack 200 is modular and includes at least a front housing 210 and a rear housing 212, which are stackable units. For example, the rear housing 212 may be modular where many different rear housings 212, such as rear housings 212 having different heights, may be provided that are matable to the same front housing 210 to change the stack height of the housing stack 200. A particular rear housing 212 is selected to provide a particular size or height receptacle assembly 102 depending on the particular application and/or spacing needed between the circuit boards 106, 108. The rear housing 212 is positioned or located rearward of the front housing 210.

As used herein, relative or spatial terms such as "top," "bottom," "front," "rear," "left," and "right", "horizontal", "vertical" are only used to distinguish the referenced elements and do not necessarily require particular positions or orientations in the electrical connector system 100 or in the surrounding environment of the electrical connector system 100.

Figure 2:
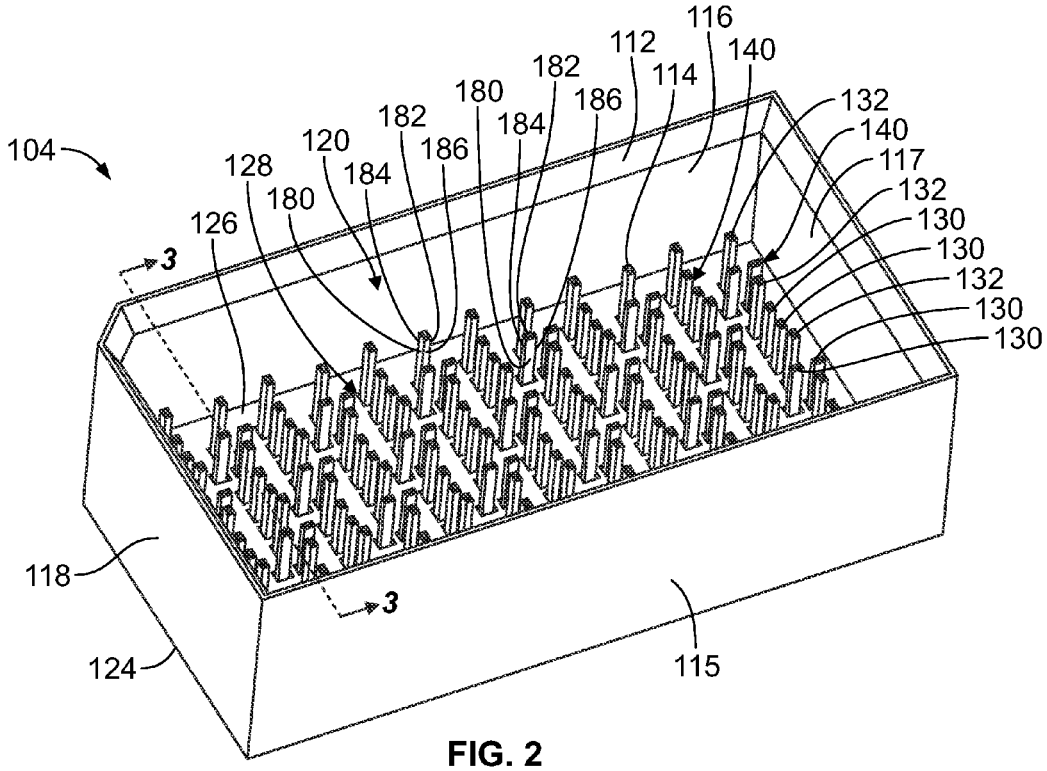
FIG. 2 is a side perspective view of the header assembly in accordance with an exemplary embodiment.
Figure 3:
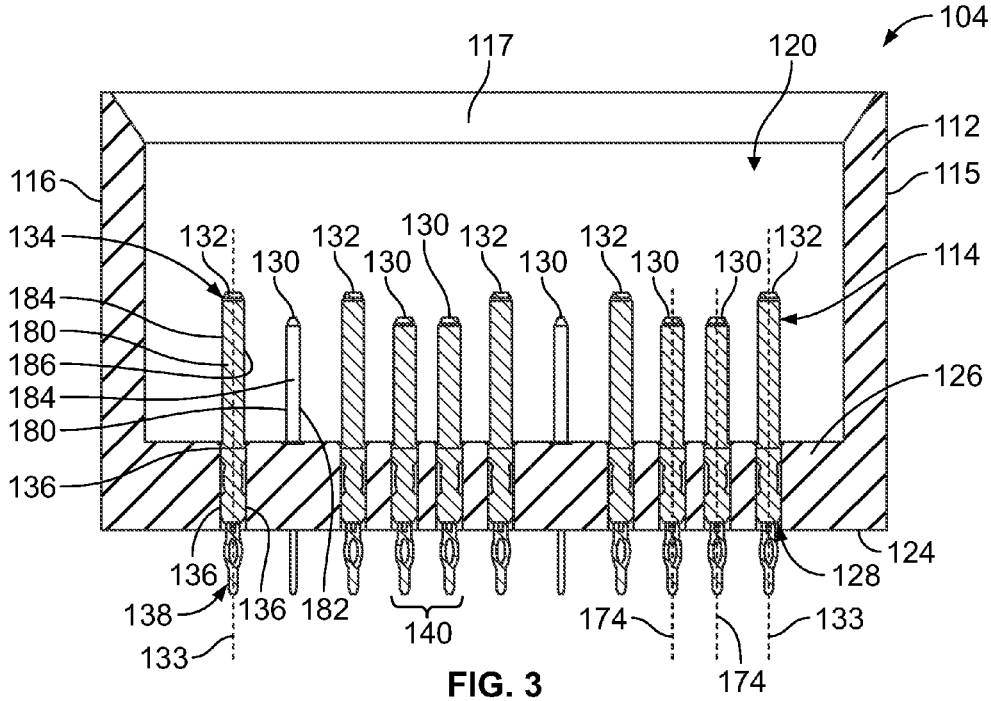
FIG. 3 is a cross-sectional view of the header assembly taken along line 3-3 shown in FIG. 2.

FIG. 2 is a side perspective view of the header assembly 104 in accordance with an exemplary embodiment. FIG. 3 is a cross-sectional view of the header assembly taken along line 3-3 shown in FIG. 2. The contacts 114 are held by the header housing 112. A base wall 126 is provided at or near the mounting end 124 that closes the bottom of the chamber 120. The contacts 114 protrude through the base wall 126 of the header housing 112 into the chamber 120. For example, the contacts 114 extend through corresponding contact cavities 128 in the base wall 126 into the chamber 120.

The contacts 114 may define signal contacts and ground contacts, which are identified by reference numbers 130 and 132, respectively. The signal and ground contacts 130, 132 are arranged in an array, such as along rows and columns in the chamber 120. Optionally, the ground contacts 132 may be longer than the signal contacts 130 to form a sequenced mating interface for mating with the receptacle assembly 102. The contacts 114 are formed of a conductive material, such as copper, a copper alloy, and/or another metal or metal alloy. The header contacts 114 extend along contact axes 133 between mating ends 134 and terminating ends 138. The contact axes 133 may extend parallel to the sides 115, 116 and/or the ends 117, 118.

In the illustrated embodiment, the contacts 114 include flat blades at the mating ends 134 that extend into the chamber 120; however the contacts 114 may have other mating interfaces in alternative embodiments, such as spring beams, sockets, pins, and the like. The terminating ends 138 are configured to engage and electrically connect to a corresponding conductor (not shown) of the circuit board 108 (shown in FIG. 1). The conductors of the circuit board 108 may be electric pads or traces, plated vias, or the like. In various embodiments, the terminating ends 138 of the contacts 114 are compliant pins, such as eye-of-the-needle pins, which are received in plated vias of the circuit board 108.

The signal contacts 130 and ground contacts 132 may be similar; however the ground contacts 132 may be longer than signal contacts 130 for sequenced mating with the receptacle assembly 102 (shown in FIG. 1). For example, distal ends of the ground contacts 132 at the mating ends 134 may be positioned further from the base wall 126 than the distal ends of signal contacts 130. In the illustrated embodiment, the terminating ends 138 are compliant pins configured to be press fit into corresponding plated vias in the circuit board 108 (shown in FIG. 1). Other types of terminating ends 138 may be provided in alternative embodiments, such as solder tails.

Each header contact 114 includes opposite broad sides 180, 182 and opposite edge sides 184, 186 narrower than the broad sides 180, 182. In an exemplary embodiment, the header contacts 114 are manufactured by stamping and forming the header contacts 114. For example, the header contacts 114 may be stamped from a blank or sheet of stock metal material. The edge sides 184, 186 are defined by the sheared or cut edges during the stamping process. The broad sides 180, 182 are defined by the planar surfaces of the sheet of stock material. Optionally, the header contacts 114 may include retention barbs 136 used to hold the header contacts 114 in the contact cavities 128. The retention barbs 136 are provided on the edge sides 184, 186. The retention barbs 136 may dig into the plastic of the header housing 112 to hold the header contacts 114 in the contact cavities 128 by an interference fit.

In an exemplary embodiment, the signal contacts 130 may be arranged in signal pairs 140. Optionally, the signal pairs 140 may be configured to convey differential signals. Alternatively, the signal contacts 130 within the pairs 140 may convey single ended signals. Select signal pairs 140 may be separated from each other by corresponding ground contacts 132. For example, the ground contacts 132 may flank opposite sides of the signal pairs 140. The ground contacts 132 provide electrical shielding between adjacent signal pairs 140.

Figure 4:
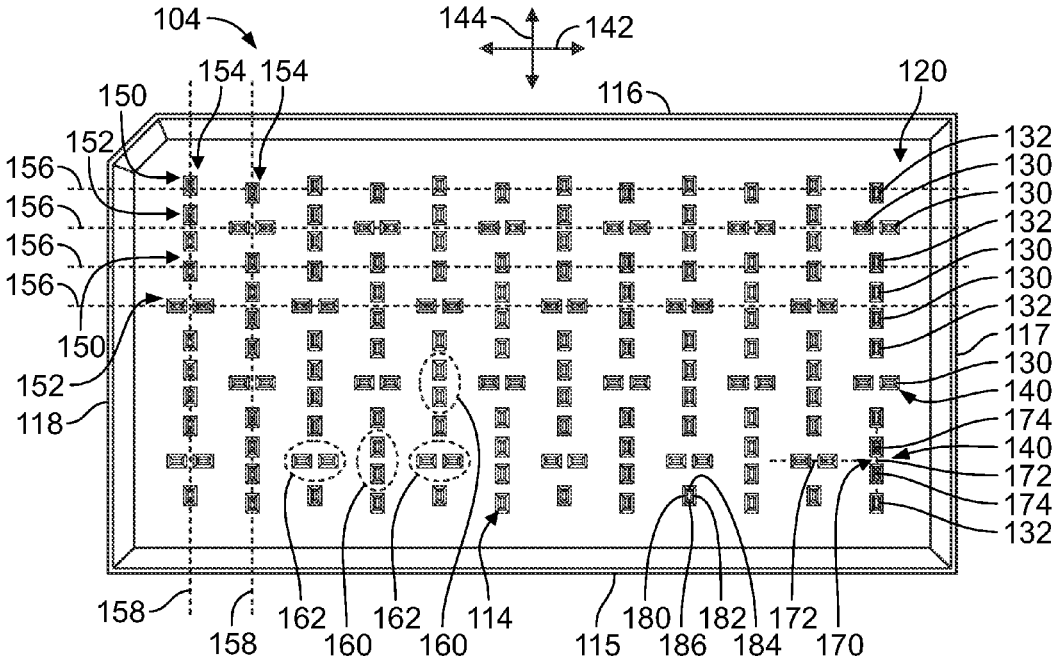
FIG. 4 is a top view of the header assembly in accordance with an exemplary embodiment.

FIG. 4 is a top view of the header assembly 104 in accordance with an exemplary embodiment. The header contacts 114 extend into the chamber 120. The chamber 120 is bounded by the sides 115, 116 and the ends 117, 118. The sides 115, 116 extend generally in a longitudinal direction 142 while the ends 117, 118 extend generally in lateral direction 144 perpendicular to the longitudinal direction 142. In the illustrated orientation, the longitudinal direction 142 is generally horizontal while the lateral direction 144 is generally vertical and the components of the receptacle assembly 102 may be referenced or compared herein with respect to such orientation; however, in use, the components do not necessarily require such orientation in the surrounding environment of the electrical connector system 100.

The header contacts 114 have a predetermined layout for termination to the circuit board 108 (shown in FIG. 1) and for mating with the receptacle assembly 102 (shown in FIG. 1). In an exemplary embodiment, the header contacts 114 are arranged in an array in rows 150, 152 and columns 154. The rows 150, 152 extend along row axes 156 and the columns 154 extend along column axes 158. The row axes 156 extend longitudinally, such as in the longitudinal direction 142, and the column axes 158 extend laterally, such as in the lateral direction 144.

In an exemplary embodiment, both signal contacts 130 and ground contacts 132 are interspersed with each other in each of the columns 154; however, in the rows, the signal and ground contacts 130, 132 are not interspersed. For example, the rows 150 define ground rows, which may be referred to hereinafter as ground rows 150, and include only ground contacts 132. The rows 152 are signal rows, which may be referred to as signal rows 152, and include only signal contacts 130. In other various embodiments, the rows 150 and/or 152 may include both signal and ground contacts 130, 132. The row axes 156 extend generally parallel to the sides 115, 116 while the column axes 158 extend generally parallel to the ends 117, 118.

As noted above, in an exemplary embodiment, the signal contacts 130 are arranged in pairs 140 in the columns 154 and are arranged in pairs 140 in the signal rows 152. The pairs 140 of signal contacts 130 have alternating horizontal and vertical orientations. For example, within the columns 154, adjacent pairs 140 have alternating horizontal and vertical orientations and, within the signal rows 152, the pairs 140 have alternating horizontal and vertical orientations.

In an exemplary embodiment, each pair 140 of signal contacts 130 defines either a column pair, which is referred to hereinafter as column pair 160, or a cross pair, which is referred to hereinafter as cross pair 162. The signal contacts 130 of each column pair 160 are arranged in-column along corresponding column axis 158. The signal contacts 130 of each cross pair 162 are arranged across the corresponding column axis 158. For example, the signal contacts 130 within each cross pair 162 flank opposite sides of the corresponding column axis 158 in close proximity to the column axis 158. While neither signal contact 130 of the cross pair 162 lies directly on the column axis 158 (which splits the pair of signal contacts 130), the pair of signal contacts 130 is considered to be part of the respective column 154 as such signal contacts 130 are both in close proximity to the column axis 158 and associated with the column 154. The field defined between the signal contacts 130 of the cross pair 162 lies across the column axis 158. Similarly, the signal contacts 130 within each column pair 160 flank opposite sides of the corresponding row axis 156 in close proximity to the row axis 156. While neither signal contact 130 of the column pair 160 lies directly on the row axis 156 (which splits the pair of signal contacts 130), the pair of signal contacts 130 is considered to be part of the respective row 152 as such signal contacts 130 are both in close proximity to the row axis 156 and associated with the row 152.

Optionally, the ground contacts 132 in the ground rows 150 may be staggered along the row axes 156. For example, some of the ground contacts 132 may be shifted to one side of the corresponding row axis 156 while other ground contacts 132 may be shifted to the other side of the corresponding row axis 156. The ground contacts 132 are staggered to accommodate and provide space for the column pairs 160. While the ground contacts 132 are slightly staggered along the row axis 156, the ground contacts 132 are considered to be part of the respective row 150 as such ground contacts 132 are in close proximity to the row axis 156 and associated with the row 150.

In an exemplary embodiment, each pair 140 of signal contacts 130 is populated on at least one side along the corresponding row axis 156 with another pair 140 of signal contacts 130. For example, the outermost pairs 140 are populated on only one side (for example, either left or right) while interior pairs 140 are populated on both sides (for example, both left and right). Each pair 140 of signal contacts 130 is populated on at least one side along the corresponding column axis 158 with another pair 140 of signal contacts 130. For example, the outermost pairs 140 are populated on only one side (for example, either above or below) while interior pairs 140 are populated on both sides (for example, both above and below).

Adjacent signal pairs 140 of the signal contacts 130 along the column axes 158 alternate between column pairs 160 and cross pairs 162. Similarly, adjacent signal pairs 140 of signal contacts 130 along the row axes 156 alternate between column pairs 160 and cross pairs 162. Each column pair 160 is surrounded on all populated sides by cross pairs 162, and similarly, each cross pair 162 is surrounded on all populated sides by column pairs 160. For example, traveling in a lateral direction along the column axis 158 (for example, up or down the column axis 158) where another signal pair 140 is present encounters an opposite type of pair. For example, traveling up or down along the column axis 158 encounters an alternating sequence of column pairs 160 and cross pairs 162. Similarly, traveling in a longitudinal direction along the row axis 156 (for example, left or right on the row axis 156) where another signal pair 140 is present encounters an opposite type of pair. For example, traveling right or left along the row axis 156 encounters an alternating sequence of column pairs 160 and cross pairs 162.

The signal contacts 130 within each pair 140 are separated by a gap 170. The gap 170 between the signal contacts 130 of each column pair 160 is in-column along the corresponding column axis 158 with the signal contacts 130 of the column pair 160. The gap 170 between the signal contacts 130 of each cross pair 162 is aligned with the column axis 158 of the corresponding column 154. Similarly, the gap 170 between the signal contacts 130 of each cross pair 162 is in-row along the corresponding row axis 156 with the signal contacts 130 of the cross pair 162. The gap 170 between the signal contacts 130 of each column pair 160 is aligned with the row axis 156 of the corresponding row 152.

The signal contacts 130 within each pair 140 have a bisector 172 defined between centerlines 174 (shown as a point in FIG. 4, the centerline 174 being shown in FIG. 3) of the corresponding signal contacts 130. The bisectors 172 span across the gaps 170 between the signal contacts 130. The bisectors 172 of the column pairs 160 are parallel to the column axes 158. The bisectors 172 of the cross pairs 162 are perpendicular to the column axis 158 and/or parallel to the row axes 156.

The ground contacts 132 are arranged between adjacent pairs 140 of signal contacts 130 in the corresponding columns 154. The ground contacts 132 thus provide electrical shielding between the pairs 140 of signal contacts 130 in the column 154. In an exemplary embodiment, the ground contacts 132 are arranged along the column axes 158. The ground contacts 132 are arranged in-column between each alternating cross pair 162 and column pair 160 in the column 154. In an exemplary embodiment, each column pair 160 is flanked on opposite sides, in the column 154, by ground contacts 132. The ground contacts 132 may be the outermost header contacts 114 in each column 154. For example, the ground rows 150 may be the outermost rows on both sides of the array of header contacts 114. For example, in the illustrated embodiment, the array of header contacts 114 includes a first ground row 150, a second signal row 152, a third ground row 150, a fourth signal row 152, a fifth ground row 150, a sixth signal row 152, a seventh ground row 150, an eighth signal row 152, and a ninth ground row 150; however, greater or fewer rows may be provided in alternative embodiments. In the illustrated embodiment, each column 154 has a contact scheme of ground contact 130, column pair 160 of signal contacts 130, ground contact 130, cross pair 162 of signal contacts 130, and ground contact 130, and may include additional ground and signal contacts 132, 130 above and/or below such contact scheme.

The broad sides 180, 182 of the signal contacts 130 of the column pair 160 are parallel to the corresponding column axis 158. The broad sides 180, 182 of the signal contacts 130 of the cross pair 162 are perpendicular to the column axis 158 and/or parallel to the row axis 156. The broad sides 180, 182 of the signal contacts 130 of the cross pair 162 are equidistant from the edge sides 184 or 186 of the signal contacts 130 of the nearest column pair 160 in the same column 154 to such cross pair 162. The broad sides 180, 182 of the signal contacts 130 of the column pair 160 are equidistant from the edge sides 184 or 186 of the signal contacts 130 of the nearest cross pair 162 in the adjacent column 154 to such column pair 160. Such a symmetric arrangement of the column pairs 160 and cross pairs 162 provides signal or noise cancelling for the differential pairs of signal contacts 130 for signal integrity, such as between pairs 140 in different columns 154. The noise cancelling effect mitigates the need for shielding between the columns 154, such as using ground contacts 132, eliminating the need for columns of ground contacts 132 between the columns of signal contacts 130. The signal contacts 130 may thus be more tightly or densely populated within the footprint of the header housing 112.

Figure 5:
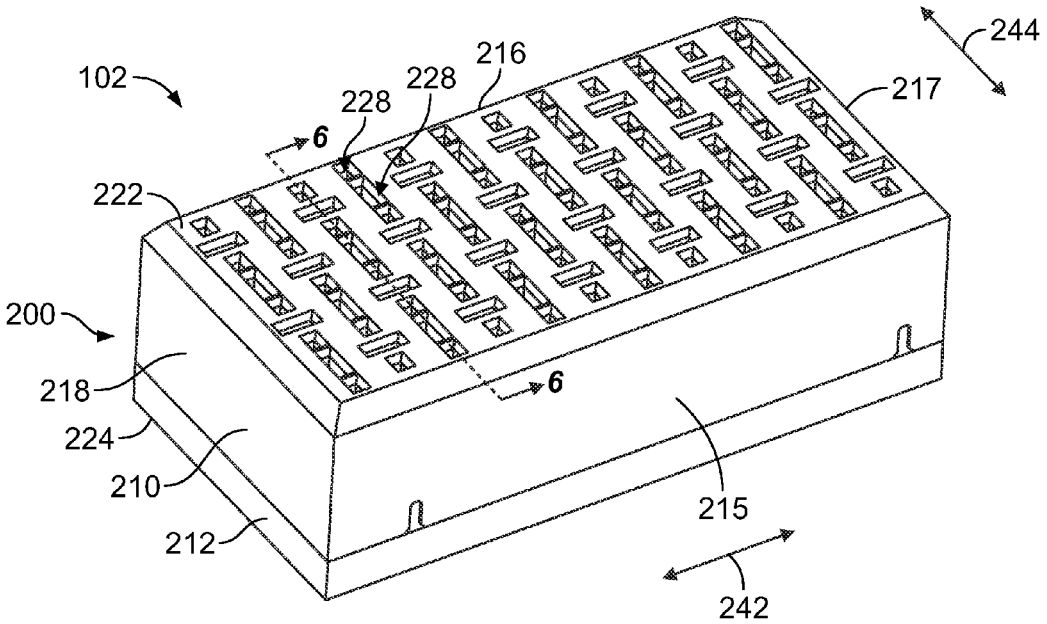
FIG. 5 is a front perspective view of the receptacle assembly in accordance with an exemplary embodiment.

FIG. 5 is a front perspective view of the receptacle assembly 102 in accordance with an exemplary embodiment. The housing stack 200 includes contact cavities 228 extending through the front housing 210 and the rear housing 212 that receive corresponding receptacle contacts 214 (shown in FIGS. 6-7). The receptacle contacts 214 may include both signal contacts and ground contacts.

In the illustrated embodiment, the rear housing 212 is shorter than the rear housing 212 shown in FIG. 1. As noted above, the rear housings 212 are modular and differently sized (for example, different height) rear housings 212 may be selectively coupled to the front housing 210 to change the stack height of the housing stack 200. The housing stack 200 includes multiple outer walls that extend between the mating and mounting ends 222, 224. For example, the housing stack 200 may include opposite sides 215, 216 and opposite ends 217, 218 (for example, both the front housing 210 and the rear housing 212 include sides 215, 216 and ends 217, 218); however the housing stack 200 may have other walls defining other shaped housings. Optionally, the sides 215, 216 are longer than the ends 217, 218 and thus the sides 215, 216 extend in a longitudinal direction 242 and the ends 217, 218 extend in a lateral direction 244. In the illustrated orientation, the longitudinal direction 242 is generally horizontal while the lateral direction 244 is generally vertical and the components of the receptacle assembly 102 may be referenced or compared herein with respect to such orientation; however, in use, the components do not necessarily require such orientation in the surrounding environment of the electrical connector system 100.

Figure 6:
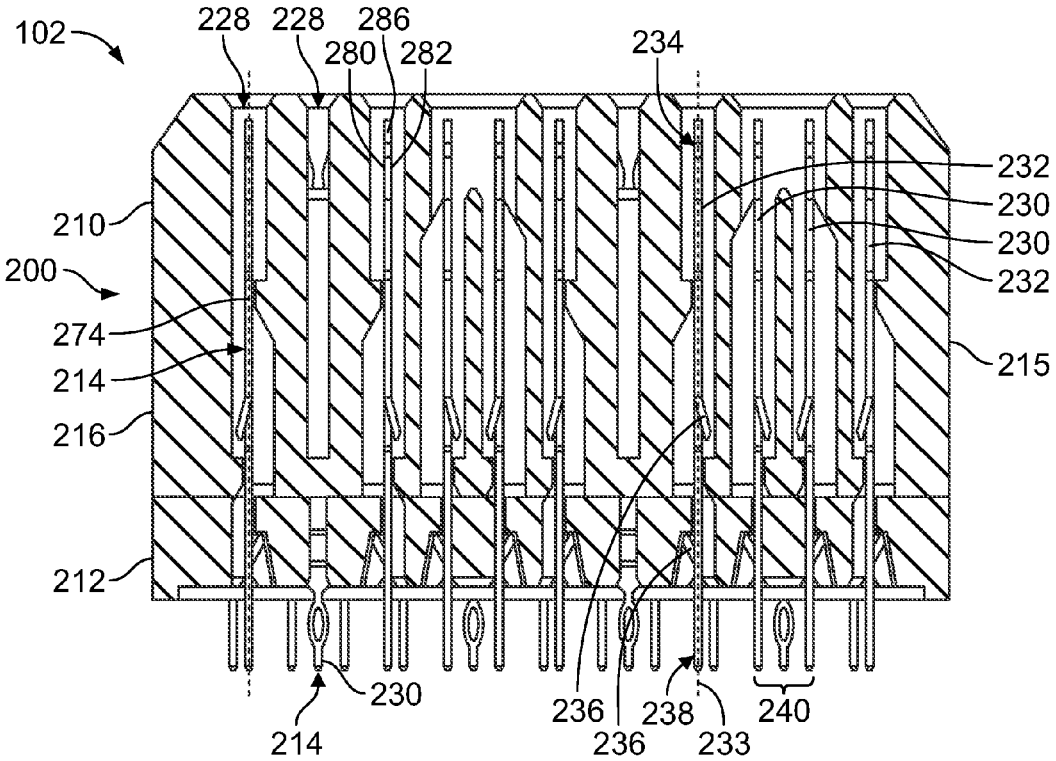
FIG. 6 is a cross-sectional view of the receptacle assembly taken along line 6-6 shown in FIG. 5.
Figure 7:
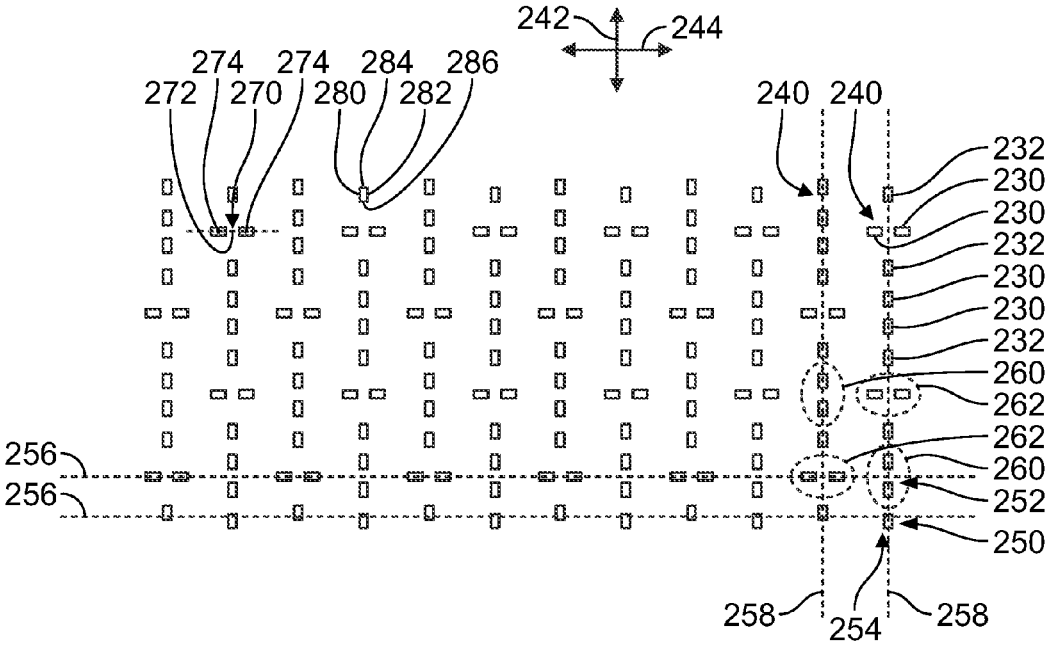
FIG. 7 is a top view of a portion of the receptacle assembly showing receptacle contacts thereof.

FIG. 6 is a cross-sectional view of the receptacle assembly 102 taken along line 6-6 shown in FIG. 5. FIG. 7 is a top view of a portion of the receptacle assembly 102 with the housing stack 200 removed to illustrate the layout of the receptacle contacts 214. As noted above, the receptacle contacts 214 include both signal contacts and ground contacts, which are identified by reference numbers 230 and 232, respectively. Optionally, the signal contacts 230 and ground contacts 232 may be similar or identical in various embodiments. The contacts 214 are arranged in an array, such as along rows and columns, within the housing stack 200. The layout or pattern of signal and ground contacts 230, 232 is complementary to the layout or pattern of the signal and ground contacts 130, 132 (shown in FIG. 4) for mating.

The receptacle contacts 214 extend along contact axes 233 between mating ends 234 and terminating ends 238. The contact axes 233 may extend parallel to the sides 215, 216 and/or the ends 217, 218. The receptacle contacts 214 are formed of a conductive material, such as copper, a copper alloy, and/or another metal or metal alloy. In the illustrated embodiment, the contacts 214 include sockets at the mating ends 234 thereof for receiving the blades of the contacts 130, 132; however the contacts 214 may have other mating interfaces in alternative embodiments, such as spring beams, pins, and the like. The terminating ends 238 are configured to engage and electrically connect to a corresponding conductor (not shown) of the circuit board 106 (shown in FIG. 1). In various embodiments, the terminating ends 238 of the contacts 214 are compliant pins, such as eye-of-the-needle pins, which are received in plated vias of the circuit board 106.

Each receptacle contact 214 includes opposite broad sides 280, 282 and opposite edge sides 284, 286 narrower than the broad sides 280, 282. In an exemplary embodiment, the receptacle contacts 214 are manufactured by stamping and forming the receptacle contacts 214. For example, the receptacle contacts 214 may be stamped from a blank or sheet of stock metal material. The edge sides 284, 286 are defined by the sheared or cut edges during the stamping process. The broad sides 280, 282 are defined by the planar surfaces of the sheet of stock material. Optionally, the receptacle contacts 214 may include retention lances or latches 236 used to hold the receptacle contacts 214 in the contact cavities 228. The retention latches 236 extend from the broad sides 280, 282. The retention latches 236 are captured against corresponding latching surfaces in the housings 210, 212 to hold the receptacle contacts 214 in the contact cavities 228.

In an exemplary embodiment, the signal contacts 230 may be arranged in signal pairs 240 configured to convey differential signals. Select signal pairs 240 may be separated from each other by corresponding ground contacts 232. For example, the ground contacts 232 may flank opposite sides of the signal pairs 240. The ground contacts 232 provide electrical shielding between adjacent signal pairs 240.

The receptacle contacts 214 have a predetermined layout for termination to the circuit board 106 (shown in FIG. 1) and for mating with the header assembly 104 (shown in FIG. 1). In an exemplary embodiment, the receptacle contacts 214 are arranged in an array in rows 250, 252 and columns 254. The rows 250, 252 extend along row axes 256 and the columns 254 extend along column axes 258. The row axes 256 extend longitudinally, such as in the longitudinal direction 242, and the column axes 258 extend laterally, such as in the lateral direction 244.

In an exemplary embodiment, both signal contacts 230 and ground contacts 232 are interspersed with each other in each of the columns 254. The rows 250 define ground rows, which may be referred to hereinafter as ground rows 250, and include only ground contacts 232. The rows 252 are signal rows, which may be referred to as signal rows 252, and include only signal contacts 230. In other various embodiments, the rows 250 and/or 252 may include both signal and ground contacts 230, 232. The row axes 256 extend generally parallel to the sides 215, 216 (FIG. 5) while the column axes 258 extend generally parallel to the ends 217, 218 (FIG. 5).

As noted above, in an exemplary embodiment, the signal contacts 230 are arranged in pairs 240 in the columns 254 and are arranged in pairs 240 in the signal rows 252. The pairs 240 of signal contacts 230 have alternating horizontal and vertical orientations. For example, within the columns 254, adjacent pairs 240 have alternating horizontal and vertical orientations and, within the signal rows 252, the pairs 240 have alternating horizontal and vertical orientations.

In an exemplary embodiment, each pair 240 of signal contacts 230 defines either a column pair, which is referred to hereinafter as column pair 260, or a cross pair, which is referred to hereinafter as cross pair 262. The signal contacts 230 of each column pair 260 are arranged in-column along corresponding column axis 258. The signal contacts 230 of each cross pair 262 are arranged across the corresponding column axis 258. For example, the signal contacts 230 within each cross pair 262 flank opposite sides of the corresponding column axis 258 in close proximity to the column axis 258. While neither signal contact 230 of the cross pair 262 lies directly on the column axis 258 (which splits the pair of signal contacts 230), the pair of signal contacts 230 is considered to be part of the respective column 254 as such signal contacts 230 are both in close proximity to the column axis 258 and associated with the column 254. The field defined between the signal contacts 230 of the cross pair 262 lies across the column axis 258. Similarly, the signal contacts 230 within each column pair 260 flank opposite sides of the corresponding row axis 256 in close proximity to the row axis 256. While neither signal contact 230 of the column pair 260 lies directly on the row axis 256 (which splits the pair of signal contacts 230), the pair of signal contacts 230 is considered to be part of the respective row 252 as such signal contacts 230 are both in close proximity to the row axis 256 and associated with the row 252.

Optionally, the ground contacts 232 in the ground rows 250 may be staggered along the row axes 256. For example, some of the ground contacts 232 may be shifted to one side of the corresponding row axis 256 while other ground contacts 232 may be shifted to the other side of the corresponding row axis 256. The ground contacts 232 are staggered to accommodate and provide space for the column pairs 260. While the ground contacts 232 are slightly staggered along the row axis 256, the ground contacts 232 are considered to be part of the respective row 250 as such ground contacts 232 are in close proximity to the row axis 256 and associated with the row 250.

In an exemplary embodiment, each pair 240 of signal contacts 230 is populated on at least one side along the corresponding row axis 256 with another pair 240 of signal contacts 230. For example, the outermost pairs 240 are populated on only one side (for example, either left or right) while interior pairs 240 are populated on both sides (for example, both left and right). Each pair 240 of signal contacts 230 is populated on at least one side along the corresponding column axis 258 with another pair 240 of signal contacts 230. For example, the outermost pairs 240 are populated on only one side (for example, either above or below) while interior pairs 240 are populated on both sides (for example, both above and below).

Adjacent signal pairs 240 of the signal contacts 230 along the column axes 258 alternate between column pairs 260 and cross pairs 262. Similarly, adjacent signal pairs 240 of signal contacts 230 along the row axes 256 alternate between column pairs 260 and cross pairs 262. Each column pair 260 is surrounded on all populated sides by cross pairs 262, and similarly, each cross pair 262 is surrounded on all populated sides by column pairs 260. For example, traveling in a lateral direction along the column axis 258 (for example, up or down the column axis 258) where another signal pair 240 is present encounters an opposite type of pair. For example, traveling up or down along the column axis 258 encounters an alternating sequence of column pairs 260 and cross pairs 262. Similarly, traveling in a longitudinal direction along the row axis 256 (for example, left or right on the row axis 256)

where another signal pair 240 is present encounters an opposite type of pair. For example, traveling right or left along the row axis 256 encounters an alternating sequence of column pairs 260 and cross pairs 262.

The signal contacts 230 within each pair 240 are separated by a gap 270. The gap 270 between the signal contacts 230 of each column pair 260 is in-column along the corresponding column axis 258 with the signal contacts 230 of the column pair 260. The gap 270 between the signal contacts 230 of each cross pair 262 is aligned with the column axis 258 of the corresponding column 254. Similarly, the gap 270 between the signal contacts 230 of each cross pair 262 is in-row along the corresponding row axis 256 with the signal contacts 230 of the cross pair 262. The gap 270 between the signal contacts 230 of each column pair 260 is aligned with the row axis 256 of the corresponding row 252.

The signal contacts 230 within each pair 240 have a bisector 272 defined between centerlines 274 (shown as a point in FIG. 7, the centerline 274 being shown in FIG. 6) of the corresponding signal contacts 230. The bisectors 272 span across the gaps 270 between the signal contacts 230. The bisectors 272 of the column pairs 260 are parallel to the column axes 258. The bisectors 272 of the cross pairs 262 are perpendicular to the column axis 258 and/or parallel to the row axes 256.

The ground contacts 232 are arranged between adjacent pairs 240 of signal contacts 230 in the corresponding columns 254. The ground contacts 232 thus provide electrical shielding between the pairs 240 of signal contacts 230 in the column 254. In an exemplary embodiment, the ground contacts 232 are arranged along the column axes 258. The ground contacts 232 are arranged in-column between each alternating cross pair 262 and column pair 260 in the column 254. In an exemplary embodiment, each column pair 260 is flanked on opposite sides, in the column 254, by ground contacts 232. The ground contacts 232 may be the outermost receptacle contacts 214 in each column 254. For example, the ground rows 250 may be the outermost rows on both sides of the array of receptacle contacts 214. For example, in the illustrated embodiment, the array of receptacle contacts 214 includes a first ground row 250, a second signal row 252, a third ground row 250, a fourth signal row 252, a fifth ground row 250, a sixth signal row 252, a seventh ground row 250, an eighth signal row 252, and a ninth ground row 250; however, greater or fewer rows may be provided in alternative embodiments. In the illustrated embodiment, each column 254 has a contact scheme of ground contact 230, column pair 260 of signal contacts 230, ground contact 230, cross pair 262 of signal contacts 230, and ground contact 230, and may include additional ground and signal contacts 232, 230 above and/or below such contact scheme.

The broad sides 280, 282 of the signal contacts 230 of the column pair 260 are parallel to the corresponding column axis 258. The broad sides 280, 282 of the signal contacts 230 of the cross pair 262 are perpendicular to the column axis 258 and/or parallel to the row axis 256. The broad sides 280, 282 of the signal contacts 230 of the cross pair 262 are equidistant from the edge sides 284 or 286 of the signal contacts 230 of the nearest column pair 260 in the same column 254 to such cross pair 262. The broad sides 280, 282 of the signal contacts 230 of the column pair 260 are equidistant from the edge sides 284 or 286 of the signal contacts 230 of the nearest cross pair 262 in the adjacent column 254 to such column pair 260. Such a symmetric arrangement of the column pairs 260 and cross pairs 262 provides signal or noise cancelling for the differential pairs of signal contacts 230 for signal integrity, such as between pairs 240 in different columns 254. The noise cancelling effect mitigates the need for shielding between the columns 254, such as using ground contacts 232, eliminating the need for columns of ground contacts 232 between the columns of signal contacts 230. The signal contacts 230 may thus be more tightly or densely populated within the footprint of the receptacle housing 212.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector assembly comprising:

a housing extending between a mating end and a mounting end, the housing defining plural contact cavities that extend through the housing between the mating end and the mounting end;

signal contacts disposed in corresponding contact cavities of the housing, the signal contacts being arranged in rows along row axes extending in a longitudinal direction and being arranged in columns along column axes extending in a lateral direction, the signal contacts being arranged in pairs, a first set of pairs of signal contacts defining column pairs being arranged in-column along the corresponding column axis, a second set of pairs of signal contacts defining cross pairs being arranged across the corresponding column axis;

wherein adjacent pairs of signal contacts along the column axes alternate between column pairs and cross pairs, and wherein adjacent pairs of signal contacts along the row axes alternate between column pairs and cross pairs; and ground contacts arranged in-column between each alternating cross pairs and column pairs.

2. The electrical connector assembly of claim 1, wherein the signal contacts of each cross pair flank opposite sides of the corresponding column axis in close proximity to the column axis.

3. The electrical connector assembly of claim 1, wherein the signal contacts of each column pair flank opposite sides of the corresponding row axis in close proximity to the row axis.

4. The electrical connector assembly of claim 1, wherein the signal contacts within each pair are separated by a gap, the gap between signal contacts of each column pair is in-column along the corresponding column axis with the signal contacts of the column pair, the gap between signal contacts of each cross pair is aligned with the column axis of the corresponding column.

5. The electrical connector assembly of claim 1, wherein each pair of signal contacts is populated on at least one side along the corresponding row axis with another pair of signal contacts and each pair of signal contacts is populated on at least one side along the corresponding column axis with another pair of signal contacts, each column pair being surrounded on all populated sides by cross pairs and each cross pair being surrounded on all populated sides by column pairs.

6. The electrical connector assembly of claim 1, wherein the signal contacts within each pair have a bisector defined between centerlines of the corresponding signal contacts, the bisectors of the column pairs being parallel to the column axis, the bisectors of the cross pairs being perpendicular to the column axis.

7. The electrical connector assembly of claim 1, wherein the ground contacts are disposed in corresponding contact cavities of the housing, the ground contacts being arranged between adjacent pairs of signal contacts in the corresponding column.

8. The electrical connector assembly of claim 7, wherein the ground contacts are arranged along the column axis.

9. The electrical connector assembly of claim 1, wherein each column pair is flanked on opposite sides, in the column, by ground contacts.

10. The electrical connector assembly of claim 1, wherein the ground contacts are disposed in corresponding contact cavities of the housing, each column having a contact scheme of ground contact, column pair of signal contacts, ground contact, cross pair of signal contacts, and ground contact.

11. The electrical connector assembly of claim 1, wherein each signal contact includes opposite broad sides and opposite edge sides narrower than the broad sides, the broad sides of the column pair being parallel to the column axis, the broad sides of the cross pair being perpendicular to the column axis.

12. The electrical connector assembly of claim 11, wherein the broad sides of the cross pairs are parallel to and along the corresponding row axes.

13. The electrical connector assembly of claim 11, wherein the broad sides of the signal contacts of the cross pair are equidistant from the edge sides of the signal contacts of the nearest column pair to such cross pair.

14. The electrical connector assembly of claim 11, wherein the signal contacts of each cross pair flank opposite sides of the corresponding column axis in close proximity to the column axis and wherein the signal contacts of each column pair flank opposite sides of the corresponding row axis in close proximity to the row axis.

15. The electrical connector assembly of claim 11, wherein the ground contacts are arranged in corresponding contact cavities of the housing, each column having a contact scheme of ground contact, column pair of signal contacts, ground contact, cross pair of signal contacts, and ground contact.

16. An electrical connector assembly comprising:

a housing extending between a mating end and a mounting end, the housing defining plural contact cavities that extend through the housing between the mating end and the mounting end;

signal contacts disposed in corresponding contact cavities of the housing, the signal contacts being arranged in rows along row axes extending in a longitudinal direction and being arranged in columns along column axes extending in a lateral direction, the signal contacts being arranged in pairs, each pair of signal contacts being populated on at least one side along the corresponding row axis with another pair of signal contacts and each pair of signal contacts being populated on at least one side along the corresponding column axis with another pair of signal contacts;

wherein each pair of signal contacts define either a column pair or a cross pair, the signal contacts of the column pair being arranged in-column along the corresponding column axis, the signal contacts of the cross pair being arranged across the corresponding column axis;

and wherein each column pair is surrounded on all populated sides by cross pairs and each cross pair is surrounded on all populated sides by column pairs; and ground contacts arranged in-column between each alternating cross pairs and column pairs.

17. The electrical connector assembly of claim 16, wherein adjacent pairs of signal contacts along the column axes alternate between column pairs and cross pairs, and wherein adjacent pairs of signal contacts along the row axes alternate between column pairs and cross pairs.

18. An electrical connector assembly comprising:

a header assembly comprising a header housing extending between a mating end and a mounting end, the mating end having a chamber, the header assembly comprising header signal contacts held by the header housing and arranged in an array in the chamber having a first layout, the header signal contacts being arranged in rows along row axes and being arranged in columns along column axes, the header signal contacts being arranged in pairs, a first set of pairs of header signal contacts defining column pairs being arranged in-column along the corresponding column axis, a second set of pairs of header signal contacts defining cross pairs being arranged across the corresponding column axis, wherein adjacent pairs of signal contacts along the column axes alternate between column pairs and cross pairs, and wherein adjacent pairs of signal contacts along the row axes alternate between column pairs and cross pairs, the header assembly having header ground contacts arranged in-column between each alternating cross pairs and column pairs of the header signal contacts; and a receptacle assembly comprising a receptacle housing extending between a mating end and a mounting end, the mating end being received in the chamber of the header housing, the receptacle assembly comprising receptacle signal contacts and receptacle ground contacts held by the receptacle housing, the receptacle signal contacts being arranged in a second layout complementary to the first layout along row axes and column axes such that the receptacle signal contacts are mated with corresponding header signal contacts, the receptacle ground contacts being mated with corresponding header ground contacts.

19. The electrical connector assembly of claim 18, wherein each pair of signal contacts is populated on at least one side along the corresponding row axis with another pair of signal contacts and each pair of signal contacts is populated on at least one side along the corresponding column axis with another pair of signal contacts, each column pair being surrounded on all populated sides by cross pairs and each cross pair being surrounded on all populated sides by column pairs.

* * * * *